US007832702B2

(12) United States Patent
Yates

(10) Patent No.: US 7,832,702 B2
(45) Date of Patent: Nov. 16, 2010

(54) ARTICLE HANGING SYSTEM

(76) Inventor: William Shuford Yates, 1416 Woodmont Dr., Greeneville, TN (US) 37743

( * ) Notice: Subject to any disclaimer, the term of this patent is extended or adjusted under 35 U.S.C. 154(b) by 0 days.

(21) Appl. No.: 12/506,626

(22) Filed: Jul. 21, 2009

(65) Prior Publication Data

US 2009/0283650 A1 Nov. 19, 2009

Related U.S. Application Data

(63) Continuation-in-part of application No. 11/959,031, filed on Dec. 18, 2007, now Pat. No. 7,566,042, and a continuation-in-part of application No. 12/490,612, filed on Jun. 24, 2009, now abandoned.

(60) Provisional application No. 60/870,446, filed on Dec. 18, 2006.

(51) Int. Cl.
*A47F 1/14* (2006.01)

(52) U.S. Cl. ..... 248/466

(58) Field of Classification Search ..... 248/466, 248/489, 682, 544
See application file for complete search history.

(56) References Cited

U.S. PATENT DOCUMENTS 4,212,123 A 7/1980 Robin
4,220,309 A 9/1980 Eisen et al.
4,241,510 A 12/1980 Radecki
4,336,884 A 6/1982 Hart et al.
4,382,337 A 5/1983 Bendick
4,455,756 A * 6/1984 Greene ..... 33/613
4,473,957 A 10/1984 Faulkner
4,512,084 A 4/1985 Lieberman
4,517,860 A 5/1985 Dameron, Jr.
4,549,713 A 10/1985 Magadini
5,103,573 A 4/1992 Ehling et al.
5,109,611 A 5/1992 Houck
5,743,507 A 4/1998 Rushing
5,802,729 A 9/1998 O'Brien et al.
6,234,440 B1 * 5/2001 Boney et al. ..... 248/354.1
6,449,863 B1 9/2002 Voorhees
6,618,955 B2 9/2003 Rice
6,663,075 B2 12/2003 Zuller
6,684,518 B2 2/2004 Voorhees
6,739,065 B2 5/2004 Hoffmeister et al.
6,782,633 B1 8/2004 Cedrone
6,898,862 B1 5/2005 Oberst
7,566,042 B1 7/2009 Yates
2001/0025393 A1 * 10/2001 Nicolette ..... 15/105
2002/0066200 A1 6/2002 Lombardo
2002/0078582 A1 6/2002 Krake et al.

(Continued)

*Primary Examiner*—J. Allen Shriver, II
*Assistant Examiner*—Erin Smith
(74) *Attorney, Agent, or Firm*—Luedeka, Neely & Graham, P.C.

(57) ABSTRACT

An article hanging system includes both a hanging tool and an attachment such as a pole. The hanging tool can be used individually or as part of the system and has a handle, a hanging arm, and an article hanger. The handle, adjacent its handle attaching end, is configured for removably attaching with a pole adjacent its pole attaching end. The hanging arm attaches the handle and the article hanger attaches the hanger arm. The handle also has a wall end for remaining stationary at a wall position, and the pole has a floor end for remaining stationary at a floor position on a floor in order that a hanging article may be displayed at a wall hanging position.

22 Claims, 15 Drawing Sheets

U.S. PATENT DOCUMENTS

| | | | |
|---|---|---|---|
| 2002/0184780 | A1 | 12/2002 | Voorhees |
| 2002/0189119 | A1 | 12/2002 | High |
| 2003/0029986 | A1 | 2/2003 | Zuller |
| 2003/0051363 | A1 | 3/2003 | Hoffmeister et al. |
| 2003/0229999 | A1 | 12/2003 | Rimback |
| 2004/0098875 | A1 | 5/2004 | Gould |
| 2004/0177527 | A1 | 9/2004 | Prevost |
| 2004/0216319 | A1 | 11/2004 | Muchnik |
| 2004/0250458 | A1 | 12/2004 | Kim |
| 2006/0096111 | A1 | 5/2006 | Dolenz et al. |
| 2006/0196069 | A1 | 9/2006 | Groepper |

* cited by examiner

ARTICLE HANGING SYSTEM

CROSS REFERENCE TO RELATED APPLICATIONS

This patent application claims priority from and is a Continuation-in-Part of U.S. patent application Ser. No. 11/959,031 filed Dec. 18, 2007 now U.S. Pat No. 7,566,042, entitled "PICTURE HANGING APPARATUS" and U.S. patent application Ser. No. 12/490,612 filed Jun. 24, 2009 now abandoned, entitled "ARTICLE HANGING SYSTEM" both of which are incorporated herein by reference in their entirety. Patent application Ser. Nos. 11/959,031 and 12/490,612 and this patent application all claim priority to U.S. Provisional Application Ser. No. 60/870,446 filed on Dec. 18, 2006, entitled "PICTURE HANGING APPARATUS," which is also incorporated herein by reference in its entirety.

FIELD

This invention relates to the field of accurately hanging items on walls. More particularly, this invention relates to a system for accurately positioning an article on a wall for hanging.

BACKGROUND

The first step in hanging a picture semi-permanently against a wall is to determine the desired height and horizontal position of the picture. Typically, a person must hold the picture against a wall and have a second person standing at a distance from the wall in order to determine the desired height and horizontal position. For the first person to be able to view the picture against the wall in the proposed position, the second person must take the first person's place as picture holder, thereby allowing the first person to back away from the wall and view the position of the picture.

Such an exercise does not address potential difficulty in locating the proper position for a hanger for the picture. For example, one type of picture hanger includes a wire strung across the back of the picture longitudinally and attached to opposite sides such that it catches a hook or wall hanger when positioned properly against the wall. Simply determining the desired position of the picture against the wall does not provide the position to place the wall hanger in the wall such that the picture will hang at the desired position. The picture, when held against the wall, impedes the person from determining where the wall hanger should be positioned.

Aligning pictures is especially difficult in the context of collages or other conglomerate design arrangements involving multiple pictures and/or other decorations. In such arrangements, slightly improperly aligned pictures and/or other decorations stand out to the observer potentially to a greater extent than slightly improperly aligned pictures and/or other decorations occupying an otherwise empty wall. The slightest mistake in positioning the wall hanger or other hanging means results in a skewed overall impression of the arrangement.

Thus, a picture hanging apparatus and system configured for use by one person, without the necessity of a second person, is needed. The ideal picture hanging apparatus allows the user temporarily to position the picture in the desired location easily in both the vertical and horizontal directions such that the user may back away from the picture hanging apparatus and the picture hanging against the wall in order to determine whether the position of the picture needs adjustment. The picture hanging apparatus provides for easy repositioning if necessary until the desired position is achieved. Finally, the picture hanging apparatus allows the user to attach the wall hanger or other hanging means into the wall at a position such that the picture will hang in the desired position when hanging on the attached wall hanger.

SUMMARY

The above and other needs are met by an article hanging tool for displaying an article at a wall hanging position. The hanging tool has a hanging arm, an article hanger, and a receiver. The hanging arm has a wall end and a hanger end. The article hanger is configured for attaching the hanging arm and for temporarily hanging an article when the article hanging tool is in an article hanging position corresponding with the wall hanging position. The receiver is for attaching proximate the wall end of the hanging arm and for coupling with an attachment thereby forming an article hanging system.

In some embodiments, the article hanging tool has a handle having a wall end for remaining stationary at a wall position on a wall when the tool is in the article hanging position. In such embodiments, the handle includes the receiver, and the hanging arm is configured for attaching the handle proximate the wall end of the hanging arm and proximate the wall end of the handle. The handle has a handle attaching end, the attachment has an attaching end, and the attachment is configured for removably attaching the handle adjacent the attaching end of the attachment and adjacent the attaching end of the handle. In some configurations, the receiver defines a receptacle adjacent the handle attaching end, and the receptacle of the receiver is configured for receiving and removably attaching the attachment adjacent its attaching end. In other configurations, the attachment defines a receptacle adjacent its attaching end, and the receptacle is configured for receiving and removably attaching the handle adjacent the handle attaching end.

In some embodiments, the hanging arm is selected from the group consisting of a string, a rope, and a chain. In some, the hanging arm is substantially flat and is attached to the wall end of the handle at a wall pivot point. In yet others, the hanging arm is disposed substantially flush against the wall when the article hanging tool is in the article hanging position.

In some applications, the article hanging tool is configured for displaying a hanging article at the wall hanging position corresponding to an article hardware position and providing accurate placement of an article hanging hardware at the article hardware position.

In another embodiment of the invention, an article hanging system displays an article at a wall hanging position. The system includes a hanging tool as discussed above and an attachment. The attachment is configured for removably attaching the receiver, and has a floor end for remaining stationary at a floor position on the floor when the article hanging system is in the article hanging position. In some embodiments, the attachment comprises a pole selected from the group consisting of a non-extendable pole and a pole configured to vary in length as desired by the user. In some applications, the pole comprises a telescoping shaft having a length, and the shaft comprising an outer portion and an inner portion for fitting inside the outer portion and extending from inside the outer portion to increase the length of the shaft and retracting into the outer portion to decrease the length of the shaft.

In some applications, the receptacle of the receiver of the handle has a threaded inner surface, and the attachment has a corresponding threaded outer surface adjacent its attaching end. The threaded inner surface of the receptacle and the threaded outer surface of the attachment are configured for removably attaching one another. In other applications, the receptacle of the attachment has a threaded inner surface and the handle has a corresponding threaded outer surface adjacent a handle attaching end, and the threaded inner surface of the receptacle of the attachment and the threaded outer surface of the handle are configured for removably attaching one another.

In another embodiment, an article hanging system for displaying an article at a wall hanging position includes a hanging tool as discussed above, a first pole and a second pole. The first pole has a first pole attaching end and a first floor end configured for remaining stationary at a floor position on the floor when the article hanging system is in a first article hanging configuration. The second pole has a second pole attaching end and a second floor end configured for remaining stationary at the floor position on the floor when the article hanging system is in a second article hanging configuration. The first floor end of the first pole is also configured for removably attaching at least with an attaching end selected from the group consisting of the handle attaching end of the handle of the hanging tool and the second pole attaching end. The second floor end of the second pole is also configured for removably attaching at least with an attaching end selected from the group consisting of the handle attaching end of the handle of the hanging tool and the first pole attaching end. The first article hanging configuration refers to the hanging tool being removably attached with the second pole and the second pole being removably attached with the first pole, and the second article hanging configuration refers to the hanging tool being removably attached with the first pole and the first pole being removably attached with the second pole.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

As used herein, the term "article" refers to any picture, painting, photograph or other thing that can be hung on a wall or other flat surface. When the term "picture" is used, it is intended as an inclusive term, that is, not only pictures are included, but also any other article that may be hung on a wall or other flat surface including, but not limited to paintings, photographs and the like.

Figure 1:
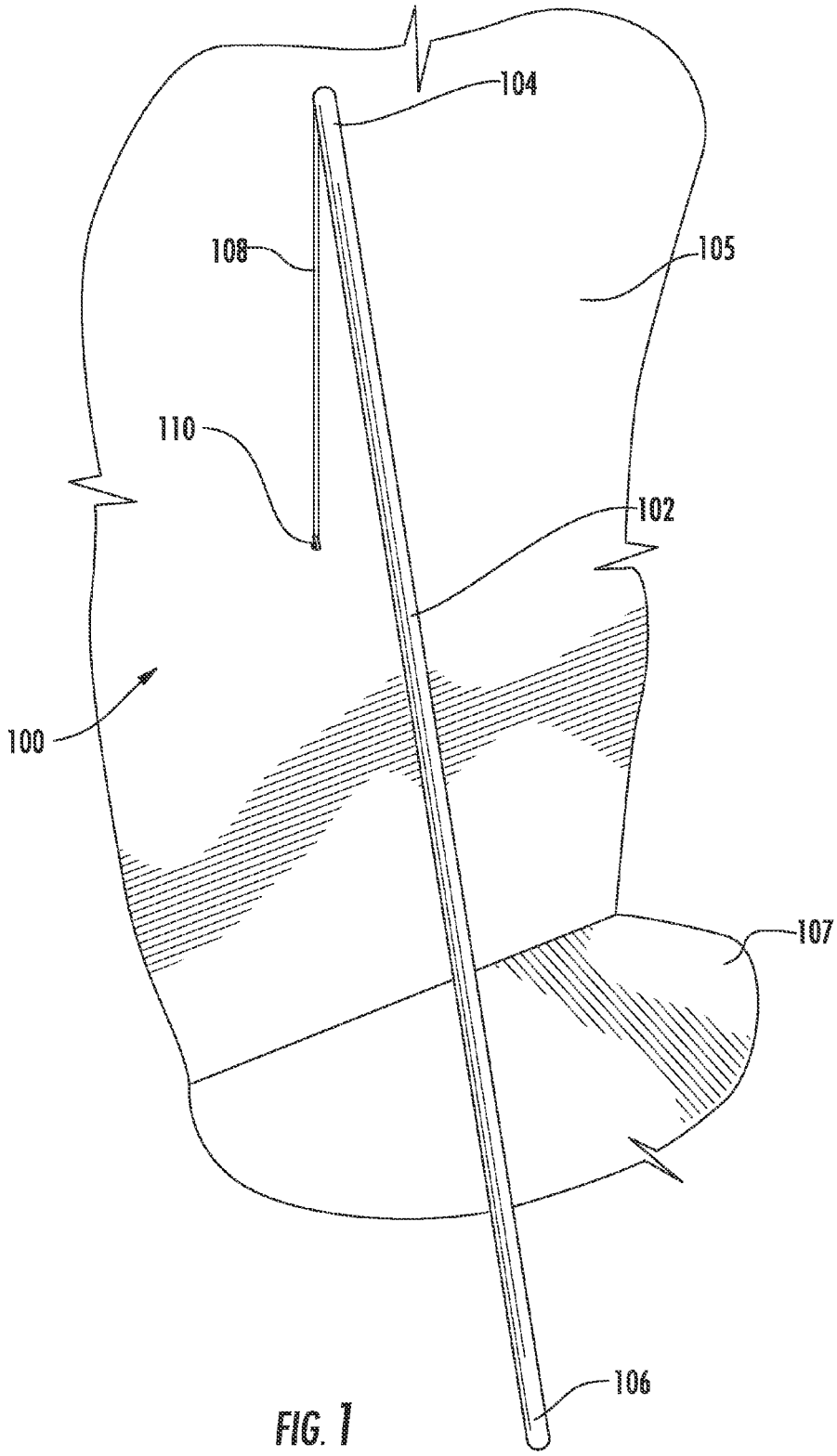
FIG. 1 is a perspective view of a picture hanging apparatus.

Referring to FIG. 1, one embodiment of the picture hanging apparatus 100 is shown. In this embodiment, the apparatus has a shaft 102, which in some embodiments is a rod or pole as shown in FIG. 1, which has a wall end 104 and a floor end 106 for contacting a wall 105 and a floor 107, respectively. The wall end 104 of the apparatus is attached to a hanging arm 108, which has a distal hanger end with an attached hanger 110. The hanger may be a hook, clasp, clamp or any other picture hanger or the like. The shaft 102 is leaned against a wall 105, and makes contact with the wall 105 at a location above which one would desire to hang a picture. When the picture is positioned in the desired picture hanging location, as used herein, the picture is in a "wall hanging position." The corresponding location on the wall where the picture hanging hardware, such as a hook or nail, should be placed in order to hang the picture at the wall hanging position is referred to herein as the "picture hardware position."

The hanger 110 is suspended on the hanging arm 108, which is attached to the shaft 102 at its wall end 104. The hanging arm 108, in this embodiment, may be a string, strap, chain or other flexible connector. In other embodiments, the hanging arm 108 may be connected via a pivot joint 410 as shown in FIGS. 4A-4I near the wall end 104 of the shaft 102. The shaft 102 leans against the wall 105 such that the hanger 110 hangs below the wall end 104 of the shaft 102 against or near the wall 105.

Figure 2A:
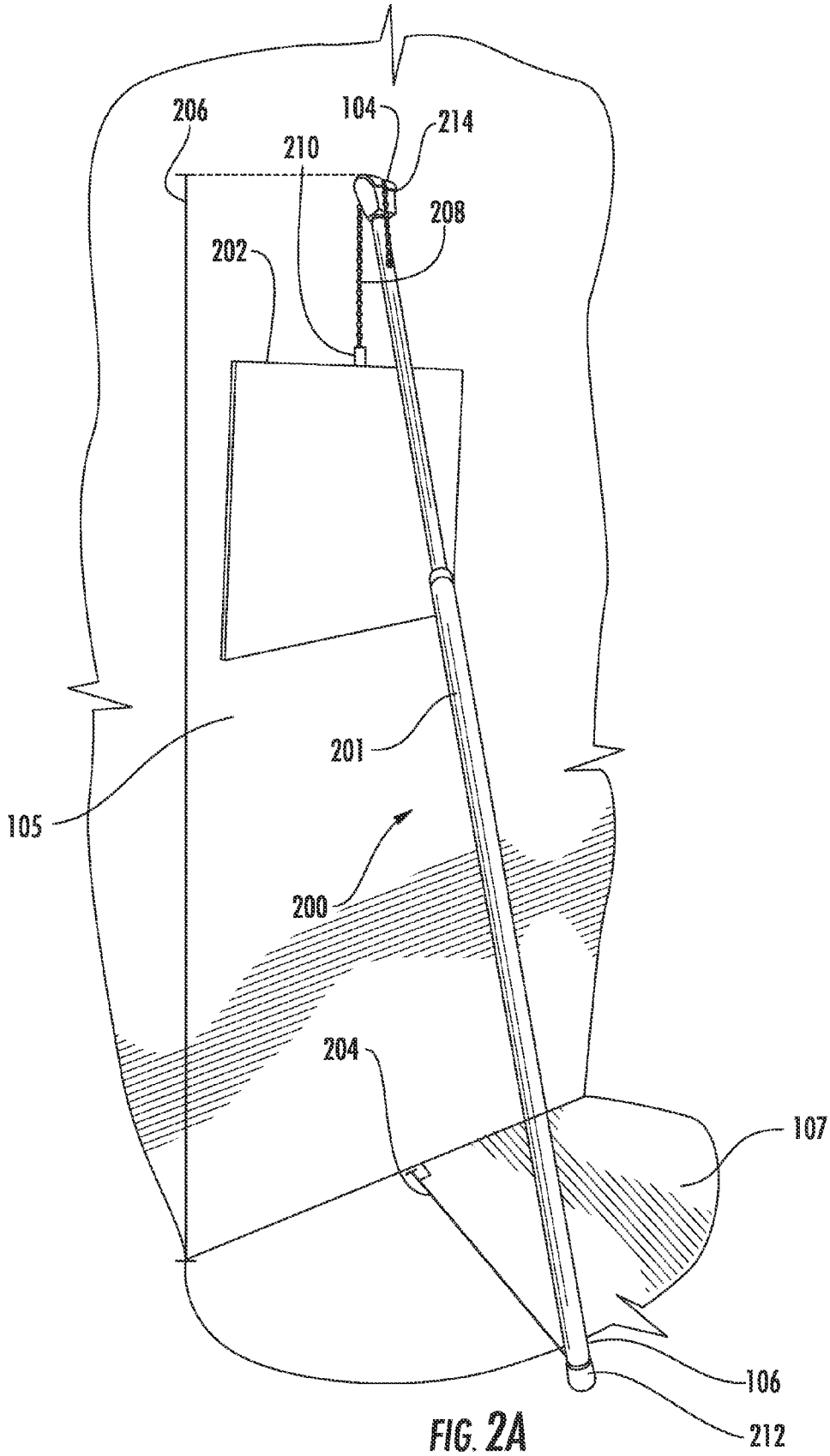
FIG. 2A is a perspective view of an alternate embodiment of the picture hanging apparatus being used to accurately position a painting.

Referring now to FIG. 2A, another embodiment of the picture hanging apparatus 200 is shown. A picture 202 is hung on a hanger 210 attached to the shaft 201 of the picture hanging apparatus 200 by hanging arm 208. The picture 202 may then be left in place temporarily without additional support, so that a user can observe the location of the picture 202 as it hangs against or near the wall 105. The user may consider the wall hanging position from a distance and may also measure the dimensions of the wall 105 and the picture 202 in order to accurately position the picture 202 at the desired wall hanging position. The user easily may reposition the picture hanging apparatus 200 and the picture 202 as necessary to achieve the desired wall hanging position. The picture hanging apparatus 200 may be repositioned by moving the shaft 201 to a different position on the floor 107 and/or the wall 105. Adjusting the shaft 201 in such a way adjusts the wall hanging position of the picture 202 by extension.

More specifically, the picture 202 is moved side to side (laterally or horizontally) by moving the shaft 201 side to side along the floor 107 and/or wall 105. The picture 202 is moved up and down (horizontally or vertically) by changing the angle of the shaft 201 relative to the wall 105. By shortening a distance 204 from the wall 105 to the floor end 212 of the shaft 201 (making the shaft 201 more upright), a height 206 at which the wall end 104 of the shaft 201 contacts the wall 105 increases, thus changing the height at which the picture 202 hangs. Once the desired wall hanging position for the picture 202 is determined, the user removes the picture 202 from the hanger 210, leaving the picture hanging apparatus 200, including the hanger 210 and the shaft 201 in place. The position of the now visible hanger 210, as illustrated in the close-up of the hanger 210 shown in FIG. 2B, indicates the picture hardware position corresponding to the picture wall hanging position. The picture hardware position is the position or location on the wall 105 where the user must attach picture hanging hardware in order for the picture 202 to hang at the desired wall hanging position when hanging from the picture hanging hardware. The user can install the picture hanging hardware with the hanger 210 in place, or mark the picture hardware position with a writing utensil such as a pencil, remove the hanger 208, and then install the permanent or semi-permanent picture hardware.

Figure 2B:
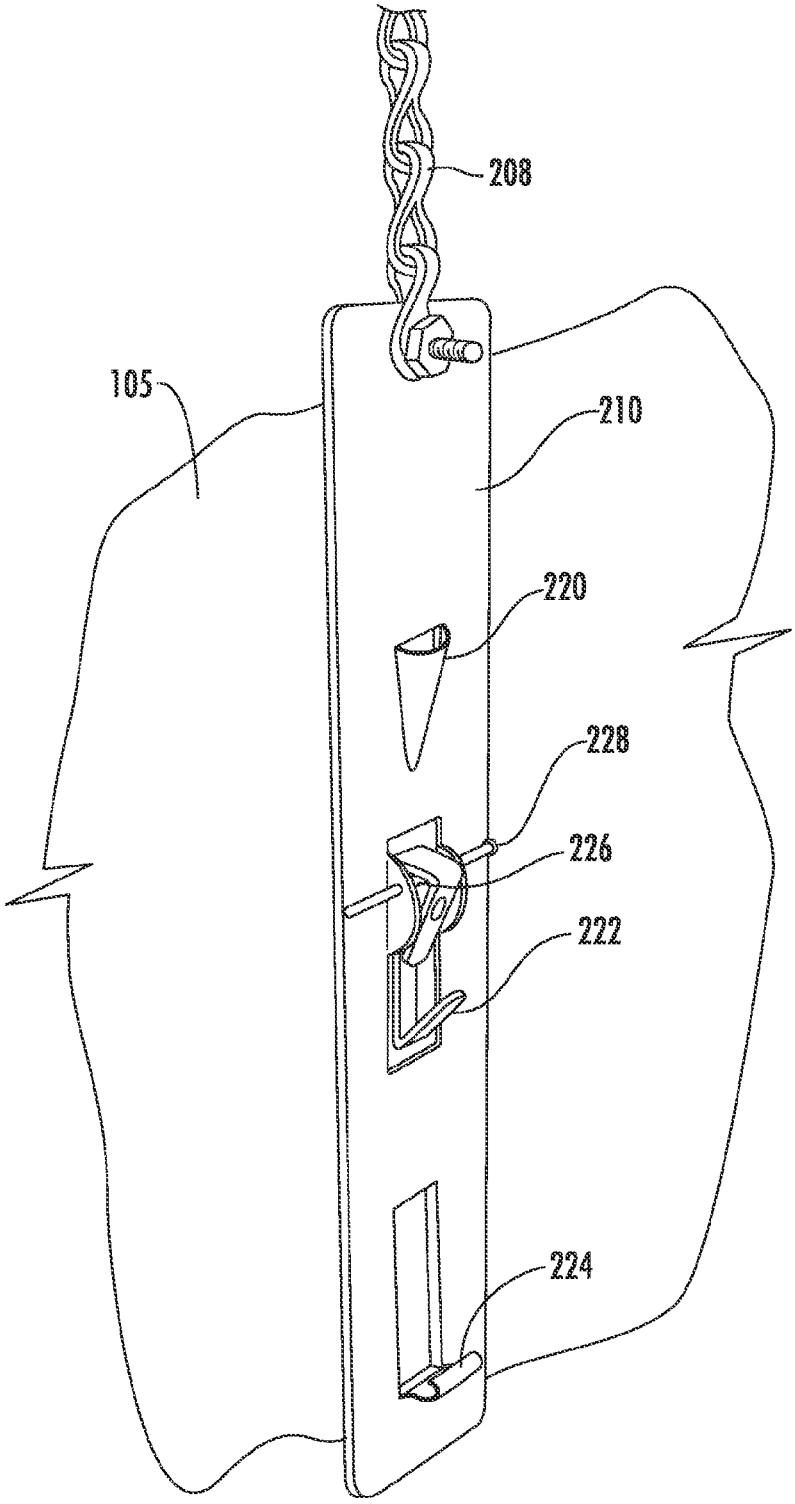
FIG. 2B is a close up view of a hanger of the embodiment of FIG. 2A.

As shown in FIG. 2B, this embodiment of the hanger 210 includes several different types of temporary hooks 220, 222, and 224. In some embodiments, the hanger 208 has only one type of temporary hook 220, 222, and 224 or may have any combination of two or more temporary hooks 220, 222, and 224. Additionally, temporary hook 222 may also function as permanent picture hardware. The user may hammer a nail through the appropriate aperture 226 in the temporary hook 222 and remove pin 228. Of course, the user should note which temporary hook 220, 222, or 224 on which he or she hangs the picture 202 before the positioning process begins as that particular temporary hook 220, 222, or 224 will ultimately indicate the accurate location of the picture hardware position.

A hanger 210 having multiple temporary hooks 220, 222 and 224 accommodates different types of picture hanging hardware as mounted to the back of the picture itself. For example, a wide flat hook, such as hook 224, works best for a picture that is suspended on a wire running across the back of the picture. A narrower, pointed hook, such as hook 220, works for pictures suspended on saw tooth type hangers. In these embodiments, the hooks 220, 222, and 224 may be made as separate units to be substituted for one another on the picture hanging apparatus 200, or may hang concurrently above and below one another on a hanger 210 as shown in FIG. 2B. In one embodiment, the temporary hooks 220, 222 and 224 are stamped into the face of a metal plate. This provides an open space above the hook for marking the wall 105 with the desired picture hardware position or mounting a permanent or semi-permanent hook.

In some embodiments, the picture hanging apparatus 200 has a hanger 210 with a hook that may function as temporary, permanent, or semi-permanent, such as 222 as discussed above. In this embodiment, hook 222 is temporarily held by the hanger 210 using the pin 228 or using a clamp. The picture hanging apparatus 200 functions in the same manner as described above, however once the picture is removed from the picture hanging apparatus 200, the user leaves the hook 222 against the wall and fastens it to the wall while it is supported by the hanger 210. The user then pulls the pin 228 or releases the clamp and removes the picture hanging apparatus 200, leaving the permanent hook 222 in the desired picture hardware position on the wall 105. In some embodiments, the temporary/permanent hook 222 is incorporated into a hanger having multiple hooks, such as the hanger 210 shown in FIG. 2B.

Referring back to FIG. 2A, in some embodiments, the shaft 201 has a non-slip foot 212 near the floor end 106 of the shaft 200. The non-slip foot 212 prevents the picture hanging apparatus 200 from sliding along the floor 107 when leaning against a wall 105. In some embodiments, the shaft 201 has a cap 214, which is rounded and/or padded in various embodiments, near the wall end 104 of the shaft 201. The cap 214 prevents the picture hanging apparatus 200 from marring or otherwise scarring the wall 105 as the picture hanging apparatus 200 leans against the wall 105. Additionally, the non-slip foot 212 and the cap 214 improve the stability of the picture hanging apparatus 200 when it is leaned against a wall 105.

In some embodiments, the shaft 201 is of variable length so that it can be extended to hang pictures 202 high on the wall 105 and be retracted for storage or for hanging pictures 202 lower on the wall 105. One type of variable length shaft 200 is a telescoping shaft as shown in FIG. 2A. The telescoping shaft 200 may be retracted to hang pictures above cabinets or furnishings such as a chest of drawers, such that the base of the shaft 200 rests on top of the cabinet or other furniture instead of being extended all the way to the floor 107. This variation in length of the shaft 200 may be accomplished by dividing the shaft 200 into separate sections which may be added or removed as necessary, by utilizing a folding pole, or by telescoping the shaft in two or more sections, referred to as an inner portion and an outer portion when two sections are used.

In some embodiments, the distance from the wall end 104 of the shaft 102 to the hanger 110 may be varied. In the embodiment of FIG. 1, the hanging arm 108, which is a string in FIG. 1, is attached, for example by tying, to the wall end 104 of the shaft 102 so that it can be loosened and adjusted to a new length. In some embodiments, a strap is used as the hanging arm 108 and is secured to the wall end 104 of the shaft 102 through a cam-type buckle, allowing the user to lengthen or shorten the strap by releasing the buckle. In some embodiments, such as those discussed with reference to FIGS. 2 and 3, a chain is used as the hanging arm 108 and is secured to the wall end 104 of the shaft 201 by a chain catch, which may be a pin or a hook.

Figure 3A:
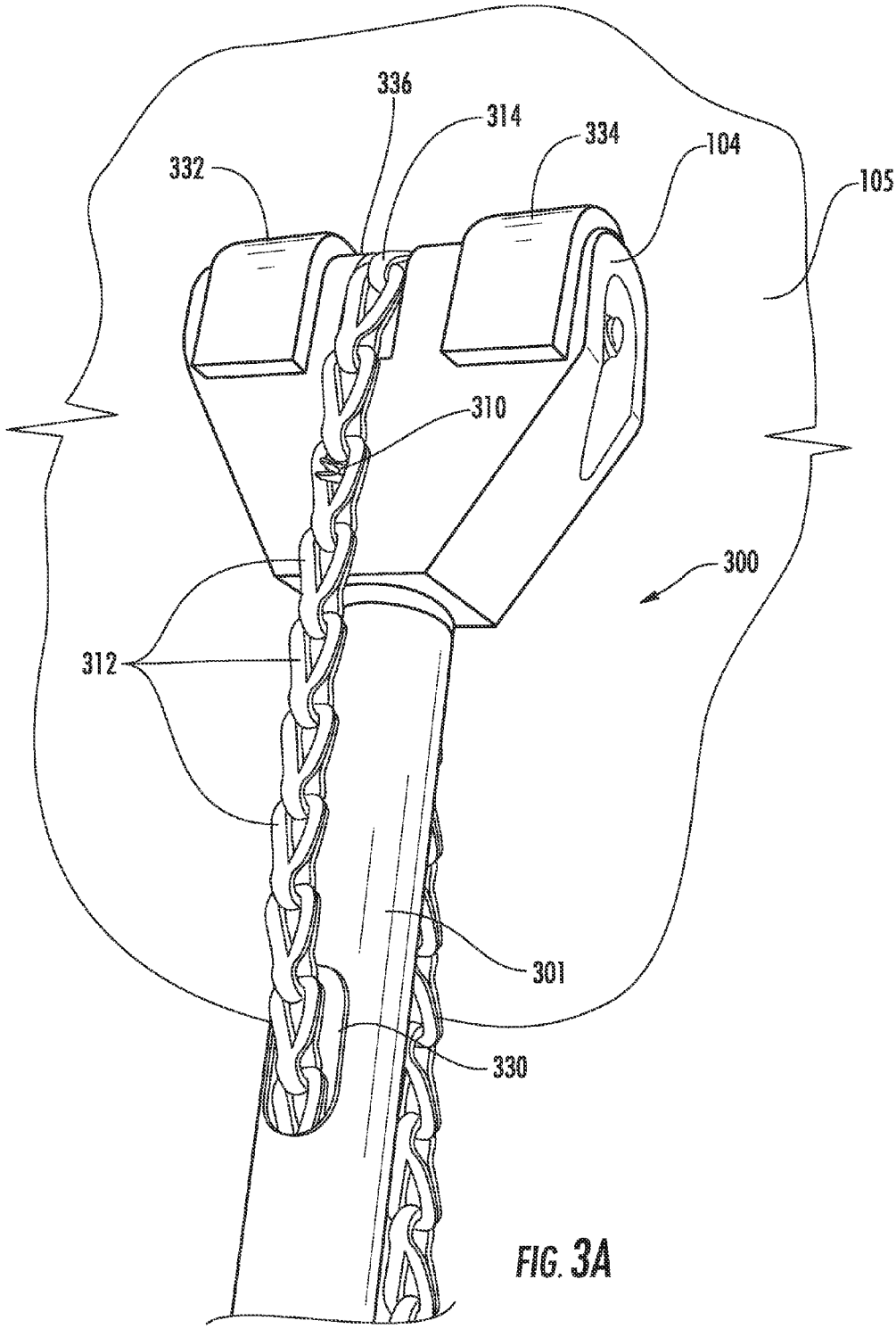
FIGS. 3A-3C are various views of another embodiment of the picture hanging apparatus having a chain.
Figure 3B:
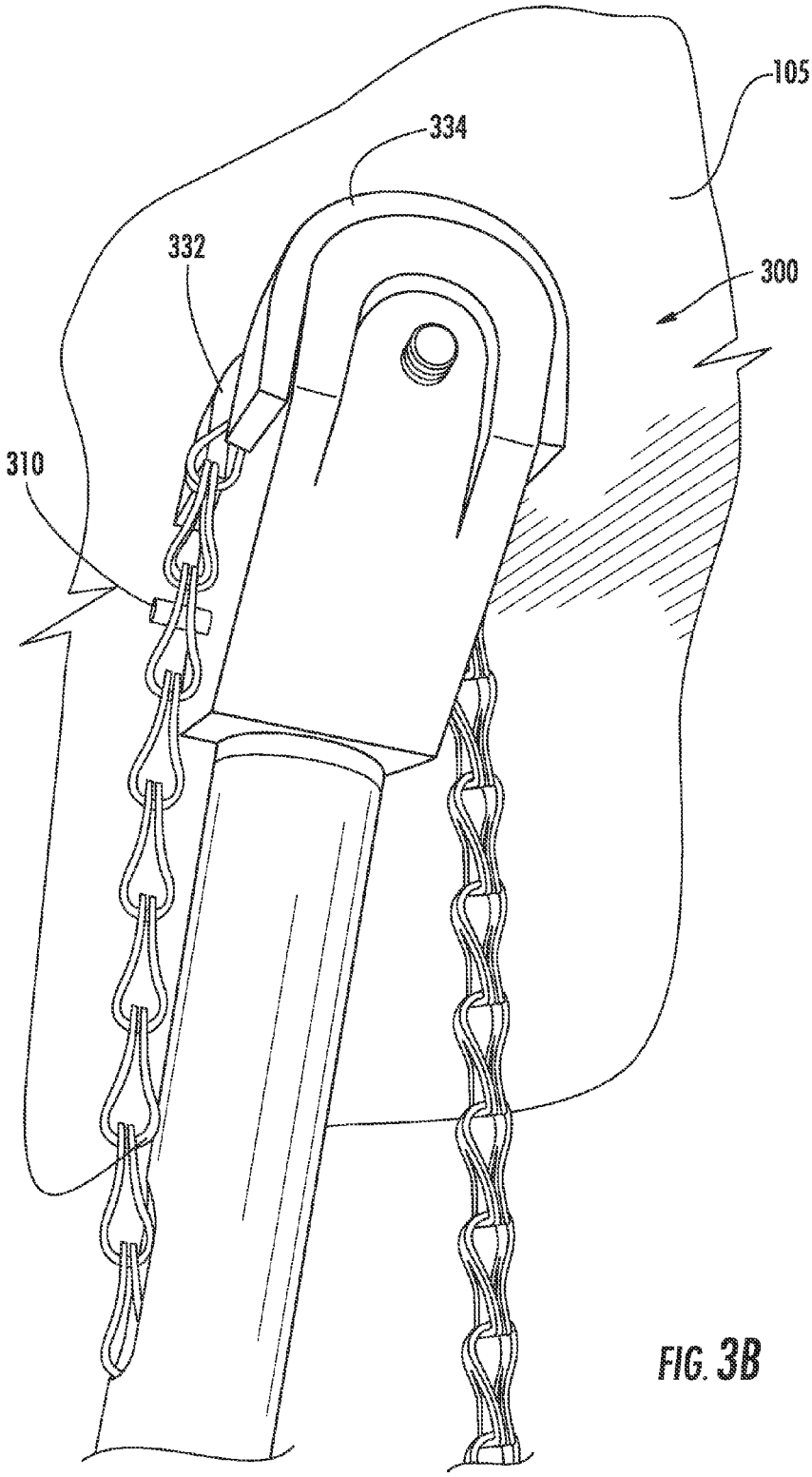
Figure 3C:
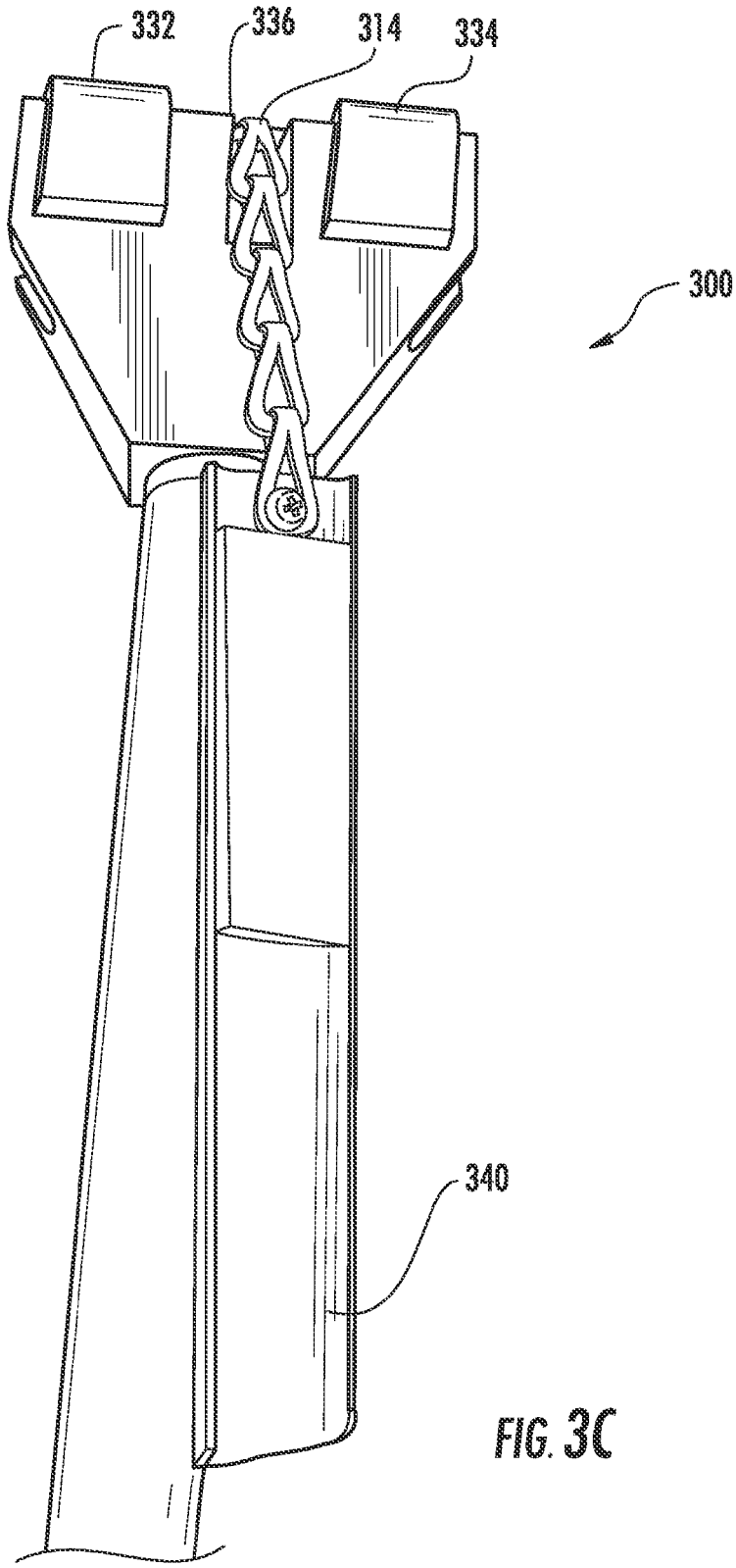

Referring now to FIGS. 3A-3C concurrently, another embodiment of the picture hanging apparatus 300 is shown. A chain catch 310 is configured for catching one of a plurality of chain links 312 which make up a chain 314. The chain catch 310 allows the chain to hang down from the wall end 104 of a shaft 301 at various lengths by engaging different chain links 312.

In some embodiments, the end of the hanging arm or chain opposite the hanger end is secured to the shaft 301 via a tie wrap or the like, or is run inside the hollow interior of the shaft 301 through an aperture 330 in the shaft 301. Rubber stops 332 and 334 are disposed at the wall end 104 of the shaft 301 and are configured for preventing the shaft 301 from sliding against the wall. A trough 336 is defined in the wall end 104 of the shaft 301 for allowing the chain 314 to glide between the wall end 104 of the shaft 301 and the wall.

Referring now to FIG. 3C, a back side 340 of a hanger 342 is shown. A rubber 344 is attached to the back side 340 of the hanger 342 in order to prevent the hanger from sliding against the wall absent a user's adjustment.

Figure 4A:
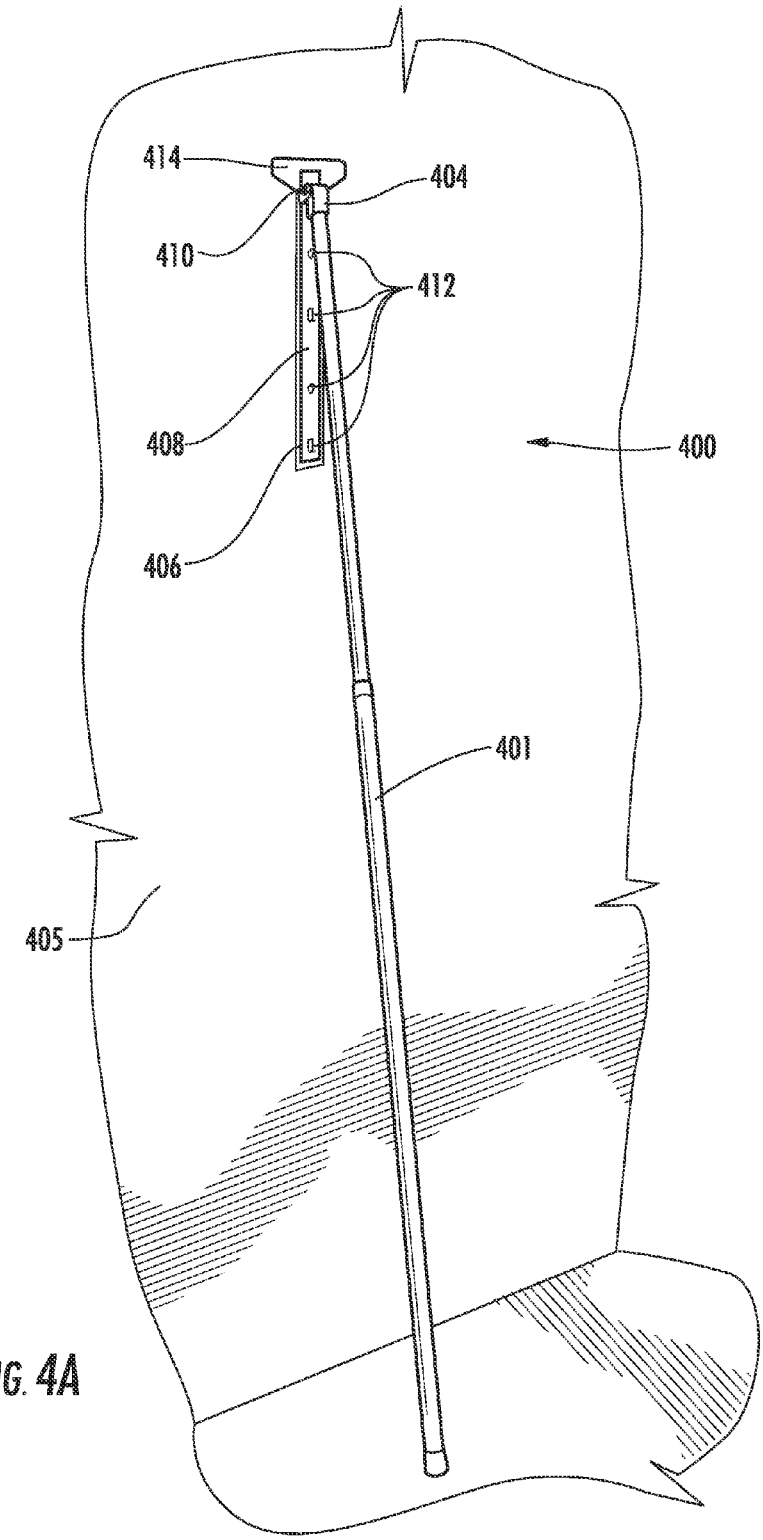
FIGS. 4A-4C are various perspective view of another embodiment of the picture hanging apparatus having a flush wall hanger.
Figure 4B:
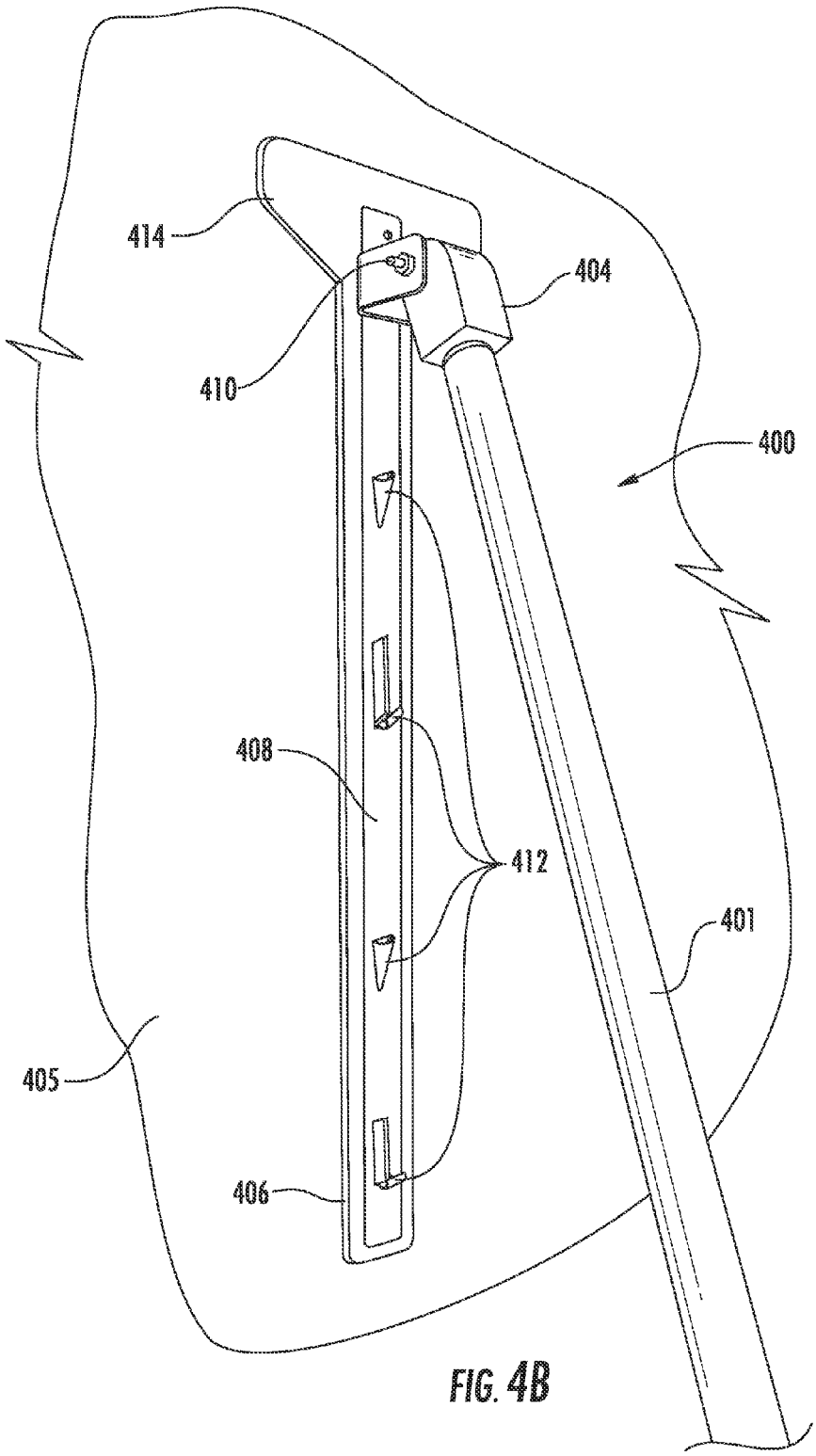
Figure 4C:
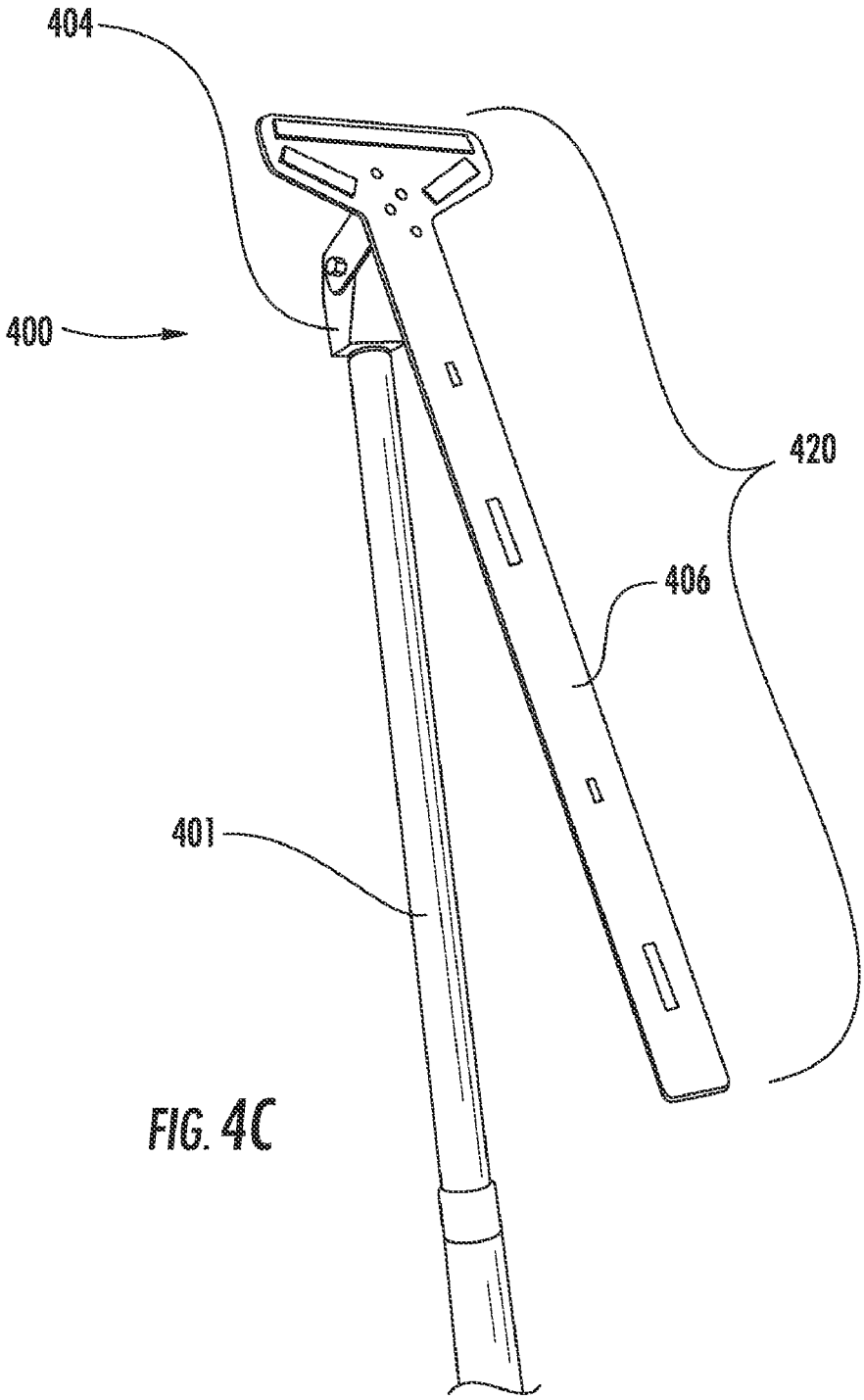

Referring to FIGS. 4A-4C concurrently, another embodiment of the picture hanging apparatus 400 is shown. This embodiment has a hanger 408 attached to an arm 406 that pivots at a pivot join 410 at the wall end 404 of the shaft 401. The arm 406, in some embodiments, is a piece of wood with a hanger 408 and a plurality of hooks 412 molded or stamped into the hanger 408 and/or arm 406 at various locations along the hanger 408 or arm's 406 vertical length. In some embodiments, the hooks 412 are made as separate units which are attached to the arm 406 along a track or the like so that the hooks may adjust their vertical position with respect to the arm 406. The arm 406, in some embodiments, has an upper arm portion 414, which extends above the pivot joint 410 at the wall end 404 of the shaft 400. The upper arm portion 414 assures that the arm 406 lay flat against the wall 405 when the picture hanging apparatus 401 is in use. In some embodiments, the arm 406 incorporates a bubble level to ensure that it is in a true vertical position when the picture hanging apparatus 401 is in use.

Figure 6A:
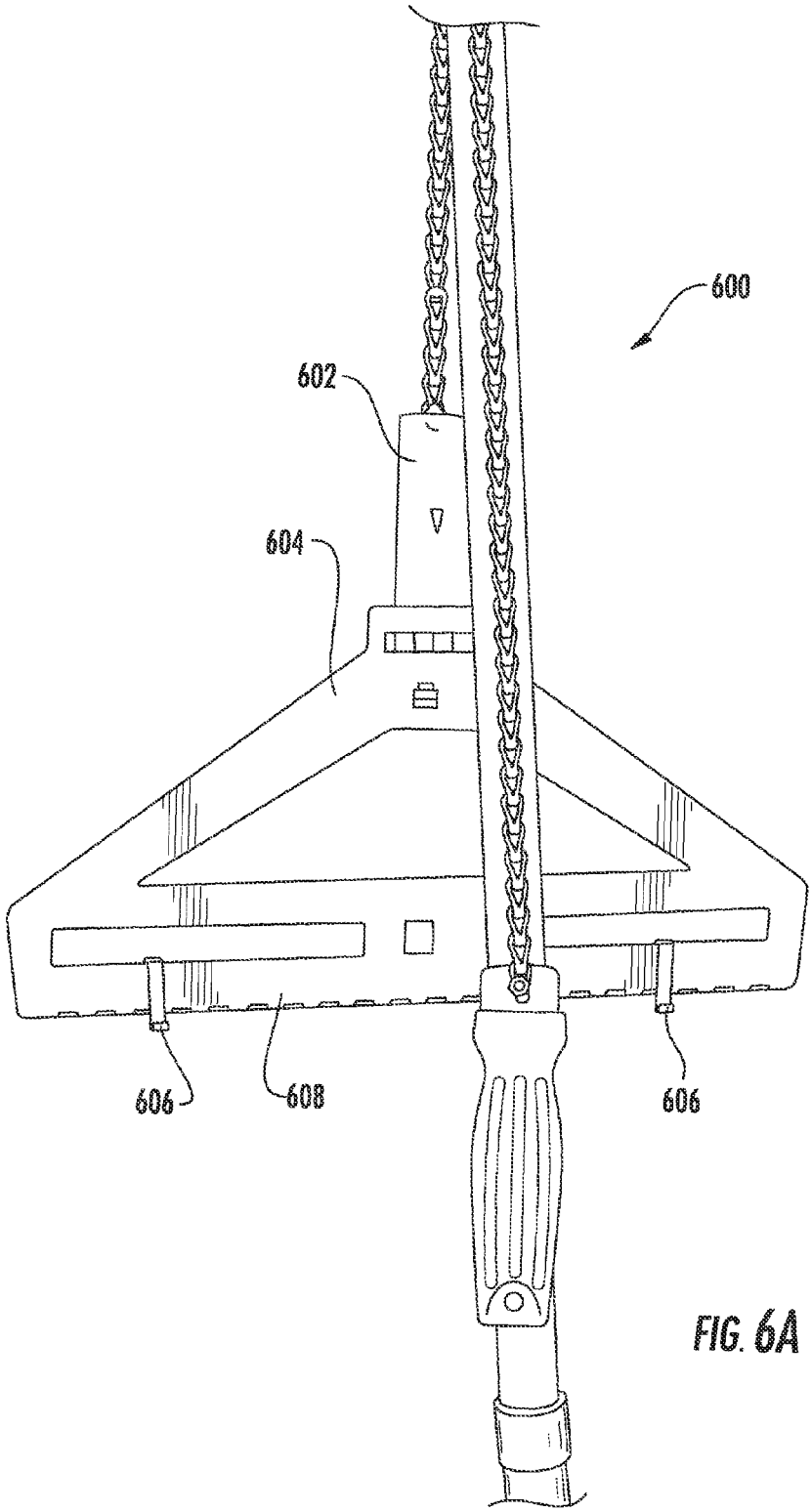
FIGS. 6A and 6B are perspective views of another embodiment of the picture hanging apparatus having a double hook hanger.
Figure 6B:
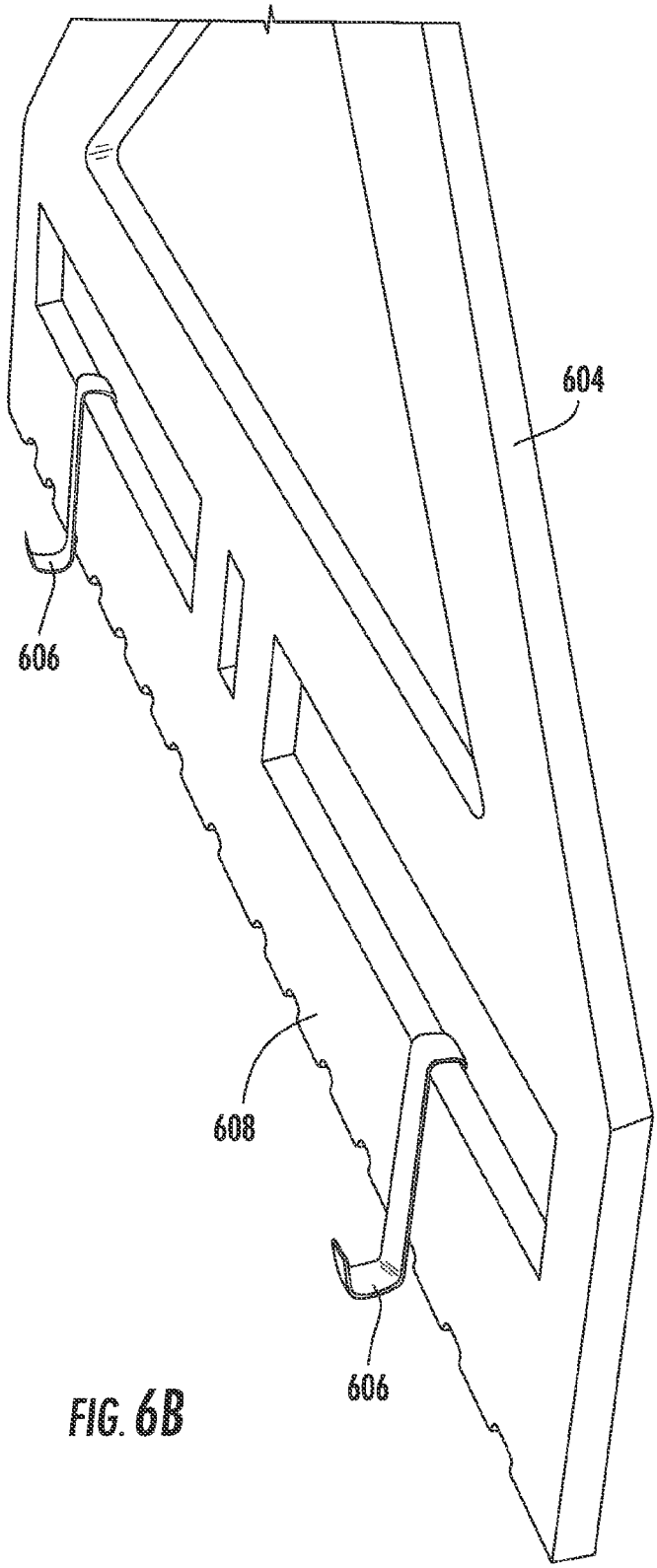

The arm 406, in some embodiments, is able to support a plurality of hooks 412, which are positioned side by side with appropriate spacing between them for the purpose of hanging a picture requiring two hooks. These hooks 412 may be of either fixed or adjustable position. A similar embodiment is shown in FIGS. 6A and 6B.

In some embodiments, the picture hanging apparatus 400 accommodates both a hanging arm, such as the string of FIG. 1 or the chain of FIGS. 2 and 3, and a rigid arm, such as the arm 406 of FIG. 4. A hanger 408 including a hook or hooks, or a hook or hooks without a hanger 408, is suspended from the hanging arm 108. Also, the stable arm 406 has a hook or hooks mounted to the arm 406 or a hanger 408 as described above. The arm 406, in some embodiments, is detachable via a removable pin at the pivot joint 410. The hanging arm 108 and its hanger and/or suspended hook(s) is also removable or retractable so that it does not interfere with the operation of the arm 406. This hybrid embodiment offers great flexibility in functionality of the picture hanging apparatus 100, 400 as various components may be interchanged as desired.

In one embodiment, the picture hanging portion 420, as shown in FIG. 4C, or just the hanging arm 108 or arm 406, is detachable from the shaft 102 or 401. The shaft 102 or 401 has a threaded wall end 404 similar to a broom handle in some embodiments. In such an embodiment, the picture hanging portion 420 screws onto the shaft 400 at the wall end 404 and provides the same functionality as the shaft 401 in the above discussion. Similarly, by detaching the picture hanging portion 420 from the shaft 401, the shaft 401 may then be used separately for any purpose that one might use the shaft 401. For example, if the shaft 401 is an extension-type shaft such as a telescoping shaft, it may be useful for attaching a broom or cleaning attachment for cleaning high windows.

Figure 5A:
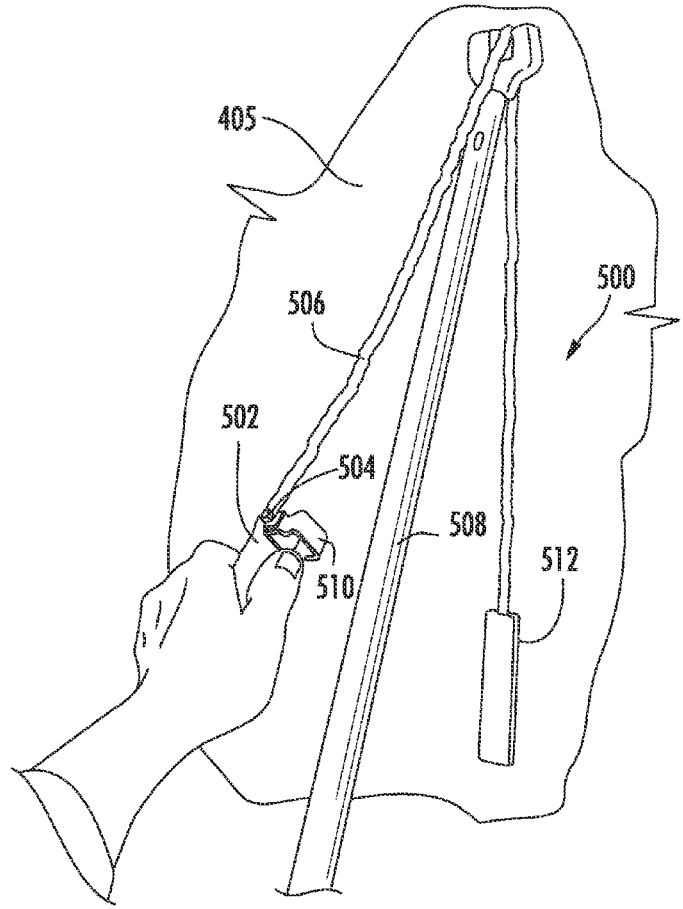
FIGS. 5A-5C are perspective views of another embodiment of the picture hanging apparatus having a handle and a clamp.
Figure 5B:
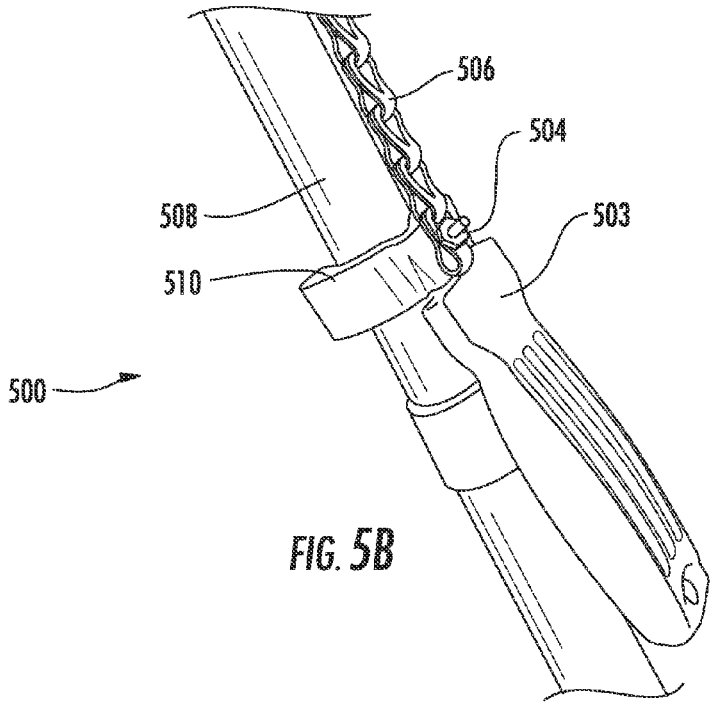

Referring now to FIGS. 5A and 5B concurrently, another embodiment of the picture hanging apparatus 500 is shown. This embodiment has a handle 502 attached to the distal end 504 of the chain 506. The handle 502 is removably attached to the shaft 508 of the picture hanging apparatus 500 by clamp 510. The user, when desiring to raise or lower the hanger 512 at the opposite end of the chain 506 from the distal end 504, detaches the clamp 510 from the shaft 508 and moves the handle 502 until the hanger 512 is at the desired height. Once the desired height is achieved, the user reattaches the clamp 510 to the shaft 508 at a new location along the shaft 508. In some embodiments, the wall hanging position is maintained because the clamping force achieved by the clamp 510 when it is attached to the shaft 508 is sufficient to counteract the force pulling the chain 506.

Figure 5C:
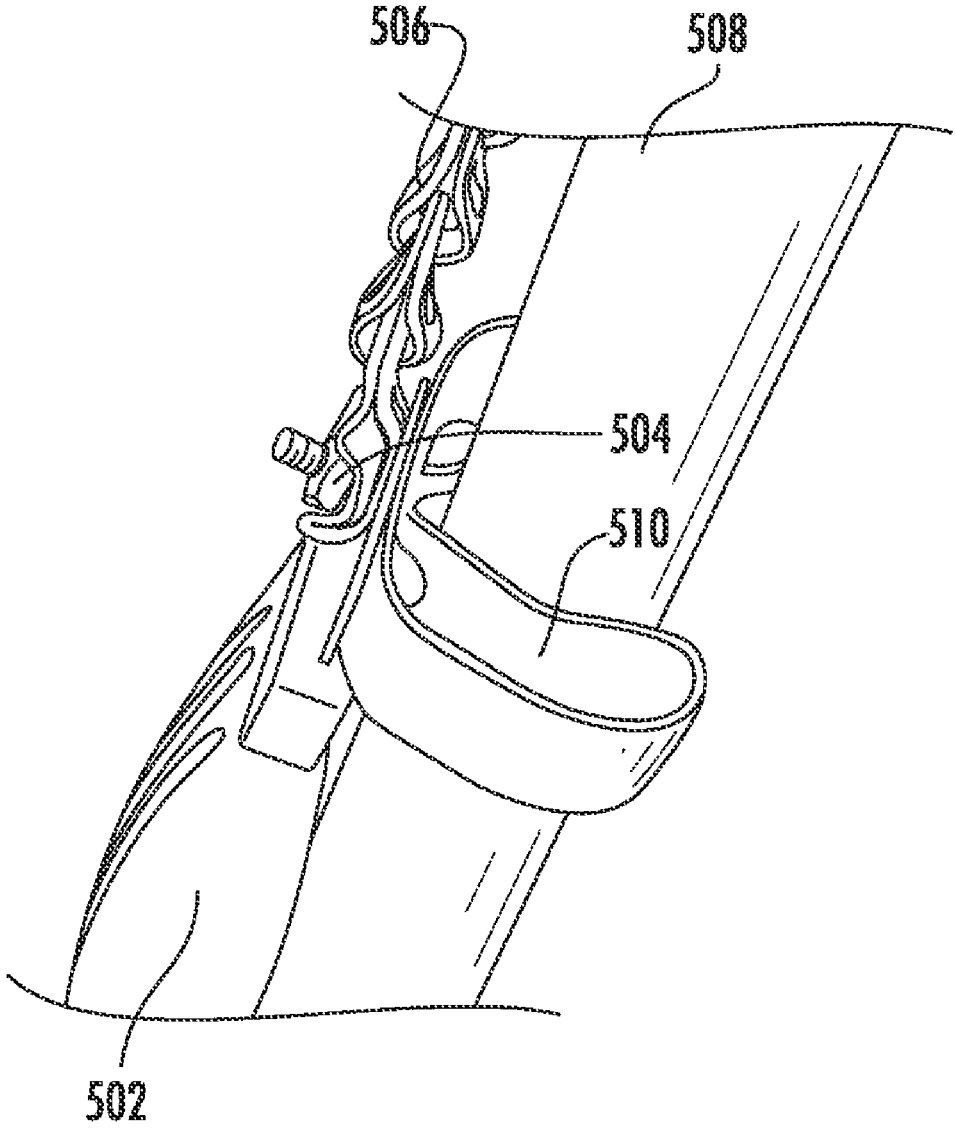

In other embodiments, the chain 506 is removably attached to a chain catch, similar to the chain catch 310 of FIG. 3 in order to maintain the desired wall hanging position. In these embodiments, the user detaches the clamp 510 from the shaft 508 and detaches the chain 506 from the chain catch (not shown), which is typically disposed proximate the wall end 104 (FIG. 3A) of the shaft 508, adjusts the picture to the desired wall hanging position, reattaches the chain 506 to the chain catch 310 and finally attaches the clamp 510 to the shaft 508. Various temporary attachment mechanisms are used in yet other embodiments in place of a clamp 510 as shown in FIG. 5.

Referring now to FIGS. 6A and 6B concurrently, another embodiment of the picture hanging apparatus 600 is shown. In this embodiment, the hanger 602 is attached to a removable double hook hanger 604. The double hook hanger 604 has two sliding hangers 606 configured to slide horizontally back and forth on the lower portion 608 of the double hook hanger 604. The double hook hanger is useful in application wherein the picture being hanged has a wire or string attached as its hanging mechanism.

Figure 7:
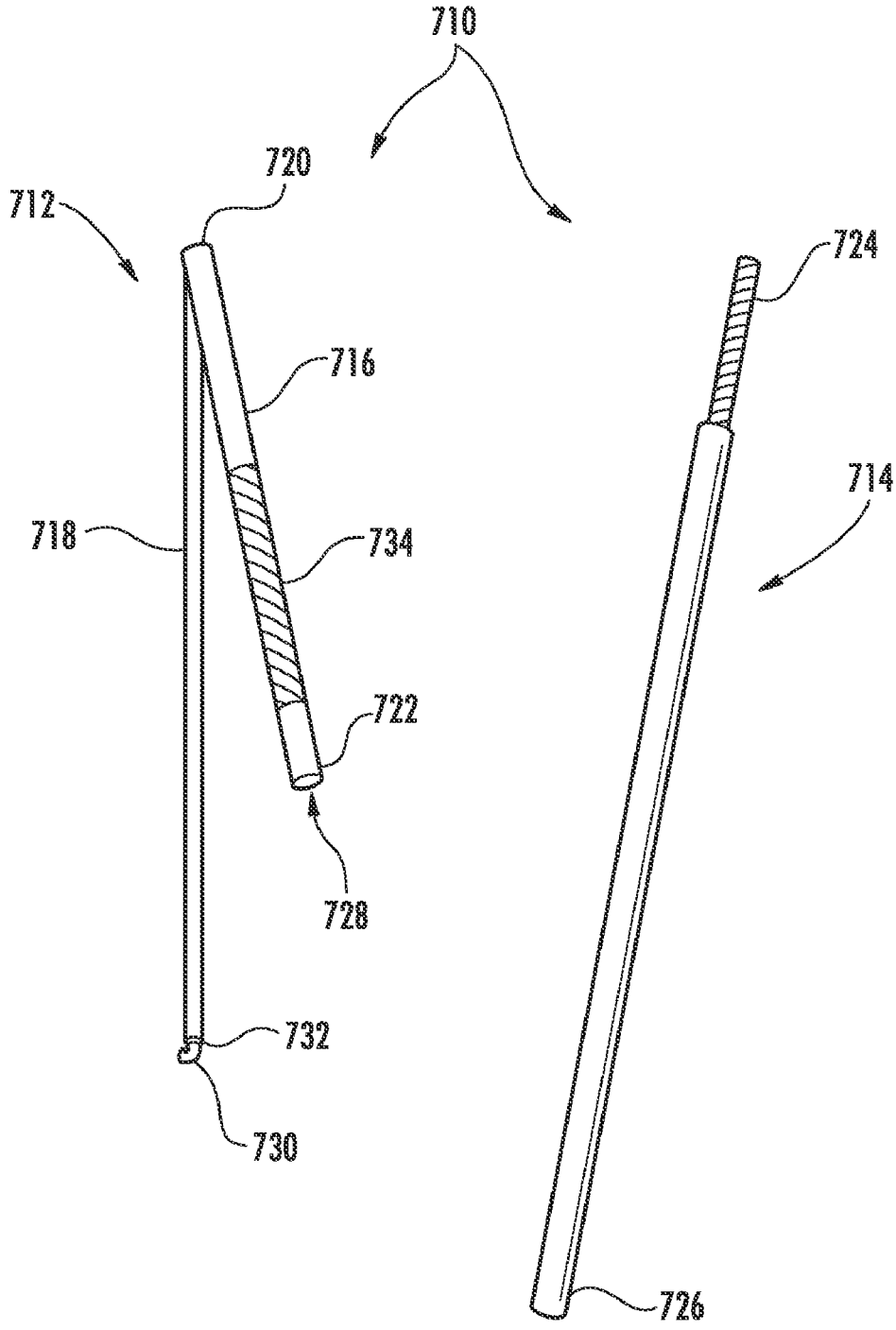
FIG. 7 is a perspective view of an article hanging system including a hanging tool and a pole.

Referring now to FIG. 7, another embodiment of the invention is shown. A system 710 includes a hanging tool 712 and a pole 714. The hanging tool 712 has a handle 716 and a hanging arm 718. The handle 716 has a wall end 720 for remaining stationary at a wall position on a wall when the system 710 is in an article hanging position and a handle attaching end 722 for receiving a pole attaching end 724 of the pole 714. The pole 714 also has a floor end 726 for remaining stationary at a floor position on a floor. The handle 716 defines a receptacle 728 adjacent the handle attaching end 722 and threaded to correspond to and removably couple with the pole attaching end 724 of the pole 714 in some embodiments. In the example shown in FIG. 7, the pole attaching end 724 is a threaded male type that corresponds with the threaded female receptacle 728 of the handle 716 In other embodiments, the pole 714 defines a threaded female type receptacle adjacent the pole attaching end 724 to correspond to and removably couple with the threaded male type handle attaching end 722 of the handle 716.

In other embodiments, various other attachment mechanisms are used. For example, the pole attaching end 724 of the pole, in some embodiments, has one or more spring-loaded balls and/or pins that must be depressed in order to slide the handle attaching end 722 of the hanging tool 712 over the pole attaching end 724 of the pole 714. These balls and/or pins couple with receiving hole(s) in the receptacle 728 of the hanging tool 712. When the user desires to remove the hanging tool 712 from the pole 714, the balls and/or pins can be depressed again and the pole attaching end 724 removed from the receptacle 726. Also, in various other embodiments, the functions of the hanger attaching end and the pole attaching ends may be reversed as demonstrated in the embodiments of the preceding paragraph.

The hanging tool 712 also has an article hanger 730 attached to a hanger end 732 of the hanging arm 718 opposite the wall end 720 for temporarily hanging an article when the system 710 is in an article hanging position. The hanger 730 can be attached anywhere along the hanging arm 718 in various embodiments.

The hanging tool 712 can be used to hang an article without attaching to the pole 714. A grip 734 is included on the handle 716 in some embodiments to allow a user sufficient grip when holding the hanging tool 712. The same hanging tool 712 can be removably attached to the pole 714 as desired to reach higher locations on a wall or for using the system 710 to hang an article without the necessity of physically holding the hanging tool 712 against the wall.

Figure 8:
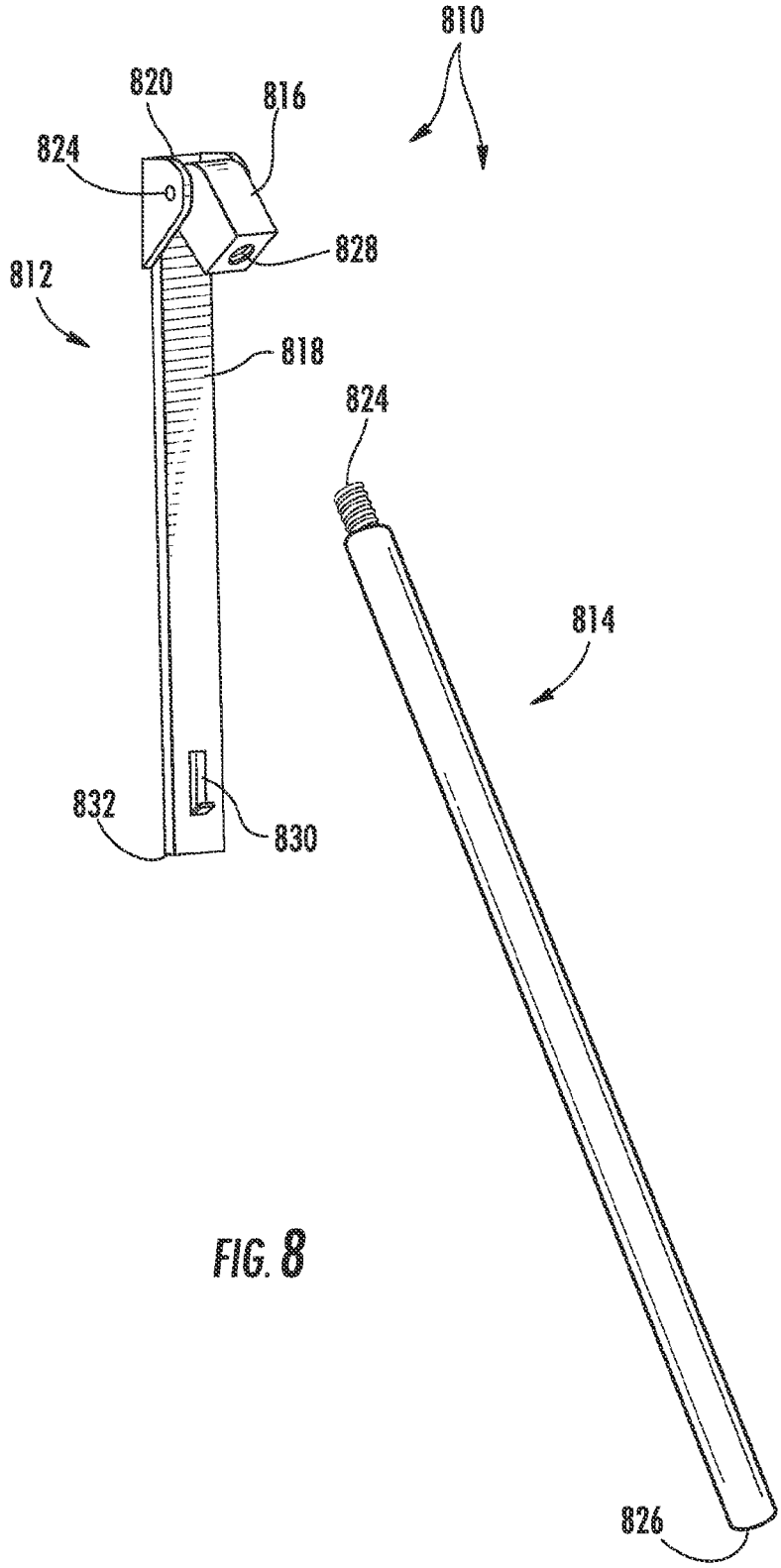
FIG. 8 is a perspective view of another embodiment of the article hanging system including a hanging tool and a pole.

Referring to FIG. 8, another embodiment of the article hanging system is shown. A system 810 includes a hanging tool 812 and a pole 814. The hanging tool 812 has a receiver 816 and a hanging arm 818. The receiver 816 is attached to the hanging arm 818 at an upper end 820 of the hanging arm 818. In the embodiment shown, the receiver 816 is attached via pivot 822 such that the hanging arm 818 can be placed against a wall at a variety of vertical locations and the receiver 816, when coupled with the pole 814, rotates about the pivot 824. Various other types of connections between the hanging arm 818 and the receiver 816 can also be used. The pivot 822 allows the pole 814 to vary position based on the height of placement of the hanging arm 818. The receiver 816 is configured for receiving a pole attaching end 824 of the pole 814. The pole 814 also has a floor end 826 for remaining stationary at a floor position on a floor when hanging an article; however, as discussed above, the pole may be repositioned in various locations on the floor to accommodate variations in placement of the hanging arm 818 and thereby the article.

The receiver 816 defines a receptacle 828 threaded to correspond to and removably couple with the pole attaching end 824 of the pole 814 in some embodiments. For example, the embodiment shown in FIG. 8 includes a threaded male type pole attaching end 824 and a threaded female type receiver receptacle 828. In other embodiments, the pole 814 defines a receptacle adjacent the pole attaching end 824 that is a female threaded type corresponding with and removably attachable with the receiver 816 that is a male threaded type.

Similar to the discussion above regarding the embodiment shown in FIG. 7, in other embodiments, various other attachment mechanisms between both the hanging arm/receiver combination and the receiver/pole combination are used, but are not specifically discussed with reference to the embodiment of FIG. 8.

The hanging tool 812 also has an article hanger 830 attached to a hanger end 832 of the hanging arm 818 opposite the upper end 820 for temporarily hanging an article when the system 810 is in an article hanging position. The hanger 830 can be attached anywhere along the hanging arm 818 in various embodiments.

The pole 814 may be considerably shorter than the pole 814 shown in FIG. 8 such that it would function as a hand-held device, which, in some applications, would not contact the floor.

Hanging tools 712, 812 can be sold separately or alongside the poles 714, 814 as a set. The pole 714, 814 is telescoping in some embodiments, and in others, the pole 714, 814 includes a receptacle at its floor end 726, 826 for receiving and attaching with the pole attaching ends 724, 824 of other poles 714, 814. The poles 714, 814 are made in various lengths and shapes to accommodate a variety of applications, for example, the shortened version of pole 814 discussed above. In some embodiments, a system 710, 810 includes one or more hanging tools 712, 812 and multiple poles 714, 814 of varying lengths, capable of attaching to one another to achieve varying article hanging heights.

An example of a system 710, 810 includes a hanging tool, a first pole, and a second pole. In this example, the hanging tool removably attaches with the second pole, and the second pole removably attaches with the first pole in a "first article hanging configuration." The "second article hanging configuration" of this example refers to the hanging tool removably attaching with the first pole, and the first pole removably attaching with the second pole. In many such embodiments, the poles include both a pole attaching end and a floor end proximate to a receptacle defined by the pole. The poles can attach with one another and with hanging tools as desired to reach an appropriate wall height for positioning and hanging an article For the sake of brevity, each and every embodiment disclosed in FIGS. 1-6 has not been re-shown as a system similar to system 710 of FIG. 7 and system 810 of FIG. 8. The systems 710 and 810 are shown as two embodiment in FIGS. 7 and 8, but it should be understood that the concepts disclosed with reference to FIGS. 7 and 8 are also applied to the embodiments shown in all of the other Figures. For example, the embodiment of the invention shown in FIGS. 2 and 3 can be modified to include both a hanging tool and a pole, the hanging tool used individually or in conjunction with the pole as a system as discussed above with reference to FIG. 7 and/or 8.

The foregoing description of preferred embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An article hanging tool for displaying an article on a wall at a wall hanging position comprising:

a. a hanging arm having a wall end and a hanger end disposed below the wall end, the hanging arm being disposed substantially flush against the wall when the article hanging tool is in an article hanging position corresponding with the wall end of the hanging arm being disposed proximate the wall, b. an article hanger attached to the hanging arm, the article hanger for temporarily hanging an article when the article hanging tool is in the article hanging position, and c. a receiver attached to the hanging arm proximate the wall end of the hanging arm for coupling with an attachment thereby forming an article hanging system.

2. The article hanging tool of claim 1 further comprising a handle having a wall end for remaining stationary at a wall position on the wall when the tool is in the article hanging position, and wherein:

a. the handle comprises the receiver; and b. the hanging arm is attached to the handle proximate the wall end of the hanging arm and proximate the wall end of the handle.

3. The article hanging tool of claim 2 wherein:

a. the handle has a handle attaching end;

b. the attachment has an attaching end; and c. the attachment is configured for removably attaching to the handle adjacent the attaching end of the attachment and adjacent the attaching end of the handle.

4. The article hanging tool of claim 3 wherein the receiver defines a receptacle adjacent the handle attaching end, the receptacle of the receiver configured for receiving and removably attaching the attachment adjacent its attaching end.

5. The article hanging tool of claim 3 wherein the attachment defines a receptacle adjacent its attaching end, the receptacle configured for receiving and removably attaching the handle adjacent the handle attaching end.

6. The article hanging tool of claim 1 wherein the hanging arm is selected from the group consisting of a string, a rope, and a chain.

7. The article hanging tool of claim 2 wherein the hanging arm is substantially flat and is attached to the wall end of the handle at a wall pivot point.

8. The article hanging tool of claim 1 wherein the article hanging tool is configured for displaying a hanging article at the wall hanging position corresponding to an article hardware position and providing accurate placement of an article hanging hardware at the article hardware position.

9. An article hanging system for displaying an article on a wall at a wall hanging position comprising:

a. a hanging tool comprising:

i. a hanging arm having a wall end and a hanger end disposed below the wall end, the hanging arm being disposed substantially flush against the wall when the article hanging tool is in an article hanging position corresponding with the wall end of the hanging arm being disposed proximate the wall, ii. an article hanger configured for attaching to the hanging arm, the article hanger for temporarily hanging an article when the article hanging tool is in, the article hanging position, and iii. a receiver attached to the hanging arm proximate the wall end of the hanging arm; and b. an attachment configured for removably attaching to the receiver, the attachment having a floor end for remaining stationary at a floor position on the floor when the article hanging system is in the article hanging position.

10. The article hanging system of claim 9 wherein the hanging tool further comprises a handle having a wall end for remaining stationary at a wall position on the wall when the tool is in the article hanging position, and wherein:

a. the handle comprises the receiver; and b. the hanging arm is configured for attaching to the handle proximate the wall end of the hanging arm and proximate the wall end of the handle.

11. The article hanging system of claim 10 wherein:

a. the handle has a handle attaching end;

b. the attachment has an attaching end; and c. the attachment is configured for removably attaching to the handle adjacent the attaching end of the attachment and adjacent the handle attaching end of the handle.

12. The article hanging system of claim 10 wherein the receiver defines a receptacle adjacent the handle attaching end, the receptacle of the receiver for receiving and removably attaching the attachment adjacent its attaching end.

13. The article hanging system of claim 10 wherein the attachment defines a receptacle adjacent its attaching end, the receptacle for receiving and removably attaching the handle attaching end of the handle of the hanging tool.

14. The article hanging system of claim 9 herein the hanging arm of the hanging tool is selected from the group consisting of a string, a rope, and a chain.

15. The article hanging system of claim 9 wherein the hanging arm of the hanging tool is substantially flat and is attached to the wall end of the handle at a wall pivot point.

16. The article hanging system of claim 9 wherein the hanging arm is disposed substantially flush against the wall when the article hanging system is in the article hanging position.

17. The article hanging system of claim 9 wherein the article hanging system is configured for displaying a hanging article at a wall hanging position corresponding to an article hardware position and providing accurate placement of an article hanging hardware at the article hardware position.

18. The article hanging system of claim 9 wherein the attachment comprises a pole selected from the group consisting of a non-extendable pole and a pole configured to vary in length as desired by the user.

19. The article hanging system of claim 18 wherein the pole comprises a telescoping shaft having a length, the shaft comprising an outer portion and an inner portion for fitting inside the outer portion and extending from inside the outer portion to increase the length of the shaft and retracting into the outer portion to decrease the length of the shaft.

20. The article hanging system of claim 12 wherein the receptacle of the receiver of the handle has a threaded inner surface and the attachment has a corresponding threaded outer surface adjacent its attaching end, the threaded inner surface of the receptacle and the threaded outer surface of the attachment configured for removably attaching one another.

21. The article hanging system of claim 13 wherein the receptacle of the attachment has a threaded inner surface and the handle has a corresponding threaded outer surface adjacent a handle attaching end, the threaded inner surface of the receptacle of the attachment and the threaded outer surface of the handle configured for removably attaching one another.

22. An article hanging system for displaying an article at a wall hanging position comprising:

a. a hanging tool comprising:

i. a handle having a wall end for remaining stationary at a wall position on a wall and a handle attaching end;

ii. a hanging arm having a wall end and a hanger end disposed below the wall end, the hanging arm being disposed substantially flush against the wall when the article is in the wall hanging position; and iii. an article hanger configured to attach to the hanging arm for temporarily hanging an article; and b. a first pole having a first pole attaching end and a first floor end configured for remaining stationary at a floor position on the floor when the article hanging system is in a first article hanging configuration;

c. a second pole having a second pole attaching end and a second floor end configured for remaining stationary at the floor position on the floor when the article hanging system is in a second article hanging configuration;

and wherein:

i. the first floor end of the first pole is also configured for removably attaching at least with an attaching end selected from the group consisting of the handle attaching end of the handle of the hanging tool and the second pole attaching end;

ii. the second floor end of the second pole is also configured for removably attaching at least with an attaching end selected from the group consisting of the handle attaching end of the handle of the hanging tool and the first pole attaching end;

iii. the first article hanging configuration refers to the hanging tool being removably attached with the second pole and the second pole being removably attached with the first pole; and iv. the second article hanging configuration refers to the hanging tool being removably attached with the first pole and the first pole being removably attached with the second pole.

* * * * *